US008857445B2

(12) United States Patent
Chuan

(10) Patent No.: US 8,857,445 B2
(45) Date of Patent: Oct. 14, 2014

(54) BI-DIRECTIONAL MULTIPLE-LAYER EXTENSION CIGAR HOLDER

(76) Inventor: Chin-Chung Chuan, Taipei (TW)

( * ) Notice: Subject to any disclaimer, the term of this patent is extended or adjusted under 35 U.S.C. 154(b) by 833 days.

(21) Appl. No.: 13/100,837

(22) Filed: May 4, 2011

(65) Prior Publication Data

US 2012/0279511 A1 Nov. 8, 2012

(51) Int. Cl.
*A24F 1/28* (2006.01)
*A24F 15/20* (2006.01)
*A24F 15/10* (2006.01)

(52) U.S. Cl.
CPC ..... *A24F 15/10* (2013.01); *A24F 15/20* (2013.01)
USPC ..... 131/191; 131/192; 131/175; 131/178; 131/185

(58) Field of Classification Search
USPC ..... 131/187, 191, 175, 178, 185, 192
See application file for complete search history.

(56) References Cited

U.S. PATENT DOCUMENTS

2009/0217933 A1* 9/2009 Chen ..... 131/185
2010/0043809 A1* 2/2010 Magnon ..... 131/178

* cited by examiner

*Primary Examiner* — Richard Crispino
*Assistant Examiner* — Dionne Walls Mayes
(74) *Attorney, Agent, or Firm* — Banger Shia

(57) ABSTRACT

A bi-directional multiple-layer extension cigar holder comprises a receiving body mounted on extension tubes which are adapted for adjusting the length of the holder for holding different lengths of cigars. The cigar holder can be combined with a lighter, enhancing the use convenience. In addition, elastic retaining rings in the cigar holder which are used to avoid disengagement are big-area C-shaped plates, such that the assembly convenience can be enhanced, synchronously enhancing the effect of preventing the disengagement of the extension tubes.

10 Claims, 15 Drawing Sheets

BI-DIRECTIONAL MULTIPLE-LAYER EXTENSION CIGAR HOLDER

BACKGROUND OF THE INVENTION

1. Field of the Invention

The present invention relates to a cigar product, and more particularly to a bi-directional multiple-layer extension cigar holder.

2. Description of the Prior Art

Referring to FIG. 15, a conventional cigar holder 10 comprises a first tube 91 and a second tube 92 that can extend and retract relative to a receiving tube 93. On each of two opposite ends of the receiving tube 93 is disposed an engaging portion 94 consisting of two half-circle plates 941. Each of the half-circle plates 941 is formed on an inner surface thereof with a protrusion 942 to be engaged in a through hole 931 in the receiving tube 93. Each of the first tube 91 and the second tube 92 is further provided at an end thereof with a bushing ring 95 which cooperates with the respective engaging portions 94 to prevent the disengagement of the respective tubes 91, 92. However, the respective half-circle plates 941 of the engaging portion 94 are difficult to assemble, thus increasing the assembly time as well as the production cost.

The present invention has arisen to mitigate and/or obviate the afore-described disadvantages.

SUMMARY OF THE INVENTION

The primary objective of the present invention is to provide a bi-directional multiple-layer extension cigar holder which is assembled with a lighter and can be adjusted in length for holding different lengths of cigars.

To achieve the above objective, a bi-directional multiple-layer extension cigar holder in accordance with the present invention comprises:

a receiving body being in the form of a hollow tube;

at least two circular bases being connected to both ends of the receiving body and formed with plural through holes in an outer surface thereof;

two extension tubes each being formed with an outer threaded portion on each of two opposite ends thereof and mounted on the receiving body, respectively;

at least two elastic retaining rings being C-shaped elastic plates, each of the elastic retaining rings including plural engaging protrusions on an inner surface thereof, the engaging protrusions of the elastic retaining rings being engaged in the through holes of the circular grooves;

a bottom storage unit being screwed to one of the outer threaded portions of one of the two extension tubes;

a medium connecting element being in the form of a ring and including a first inner threaded portion and a second inner threaded portion in both ends thereof, the medium connecting element being screwed on one of the outer threaded portions of the other one of the two extension tubes through the first inner threaded portion; and a lighter including an outer threaded portion on an outer surface thereof, the lighter being screwed into the second inner threaded portion of the medium connecting element through the outer threaded portion thereof.

The bi-directional multiple-layer extension cigar holder in accordance with the present invention can be adjusted in length for holding different lengths of cigars. In addition, the bi-directional multiple-layer extension cigar holder can be combined with a lighter for enhancing convenience in use, and the big-area C-shaped plate structured elastic retaining rings can further facilitate assembly and enhance the function of preventing the disengagement of the extension tubes.

DETAILED DESCRIPTION OF THE PREFERRED EMBODIMENTS

Figure 1:
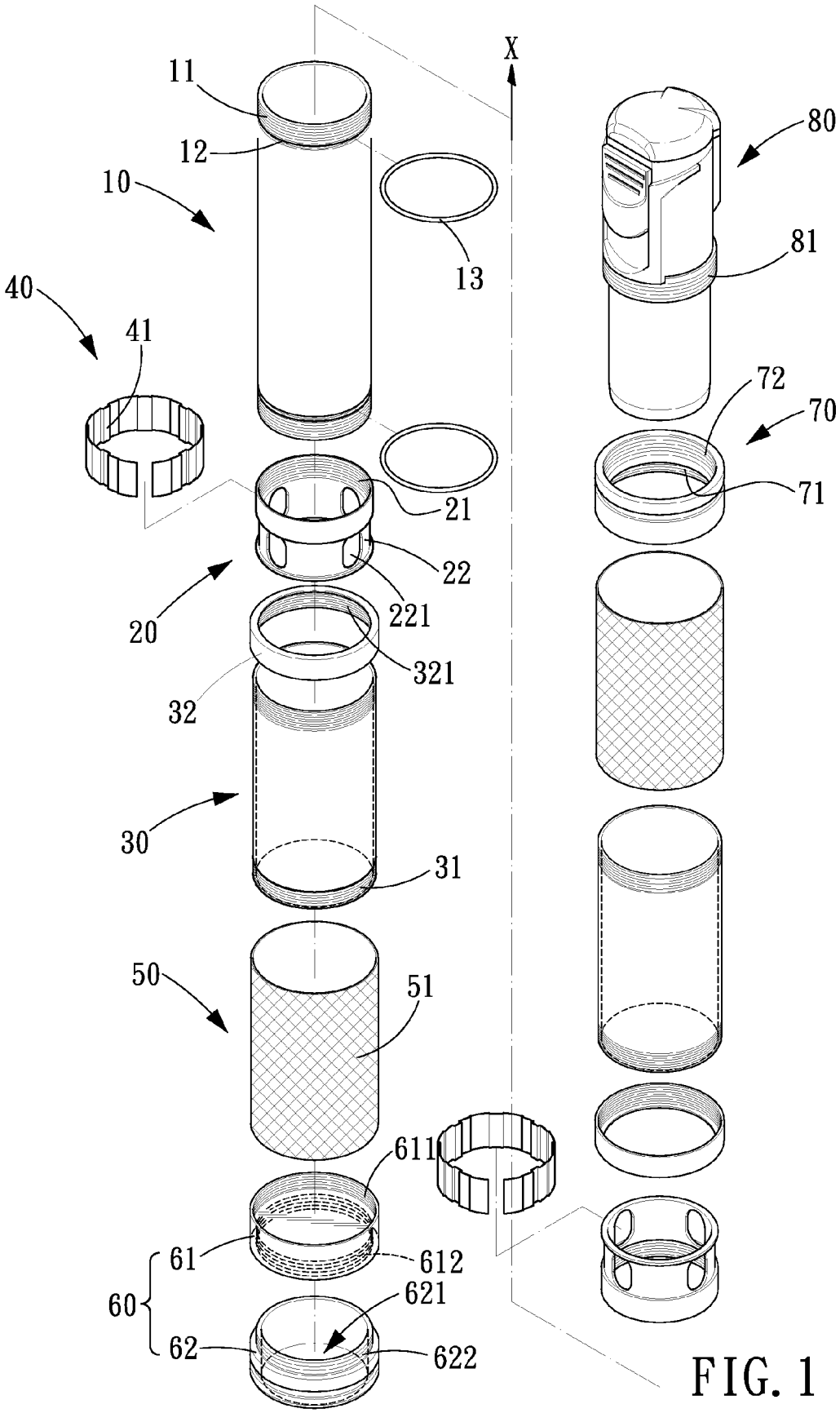
FIG. 1 is an exploded view of a bi-directional multiple-layer extension cigar holder in accordance with the present invention.
Figure 2:
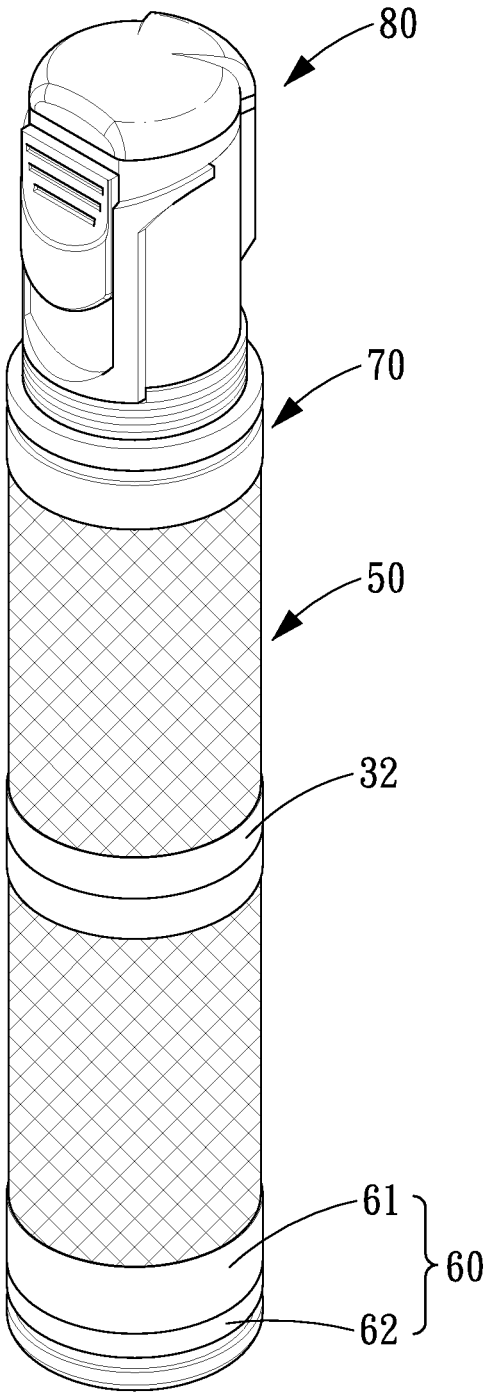
FIG. 2 is an assembly view of the bi-directional multiple-layer extension cigar holder in accordance with the present invention.
Figure 3:
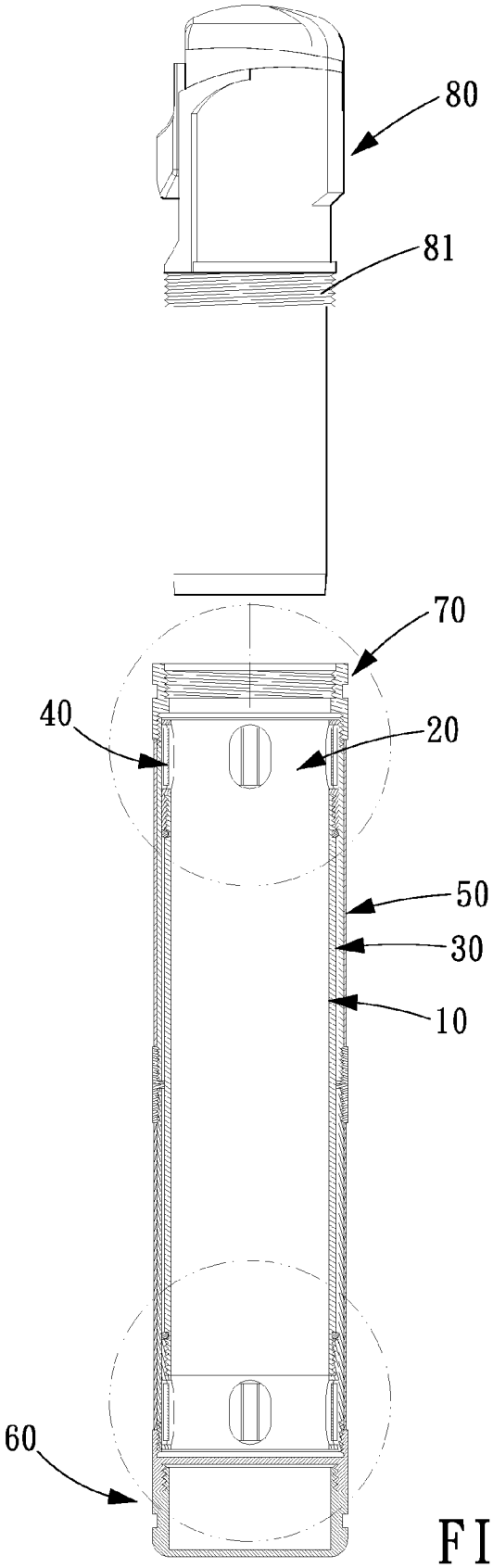
FIG. 3 is a cross-sectional view showing that the lighter is separated from the bi-directional multiple-layer extension cigar holder in accordance with the present invention.
Figure 4:
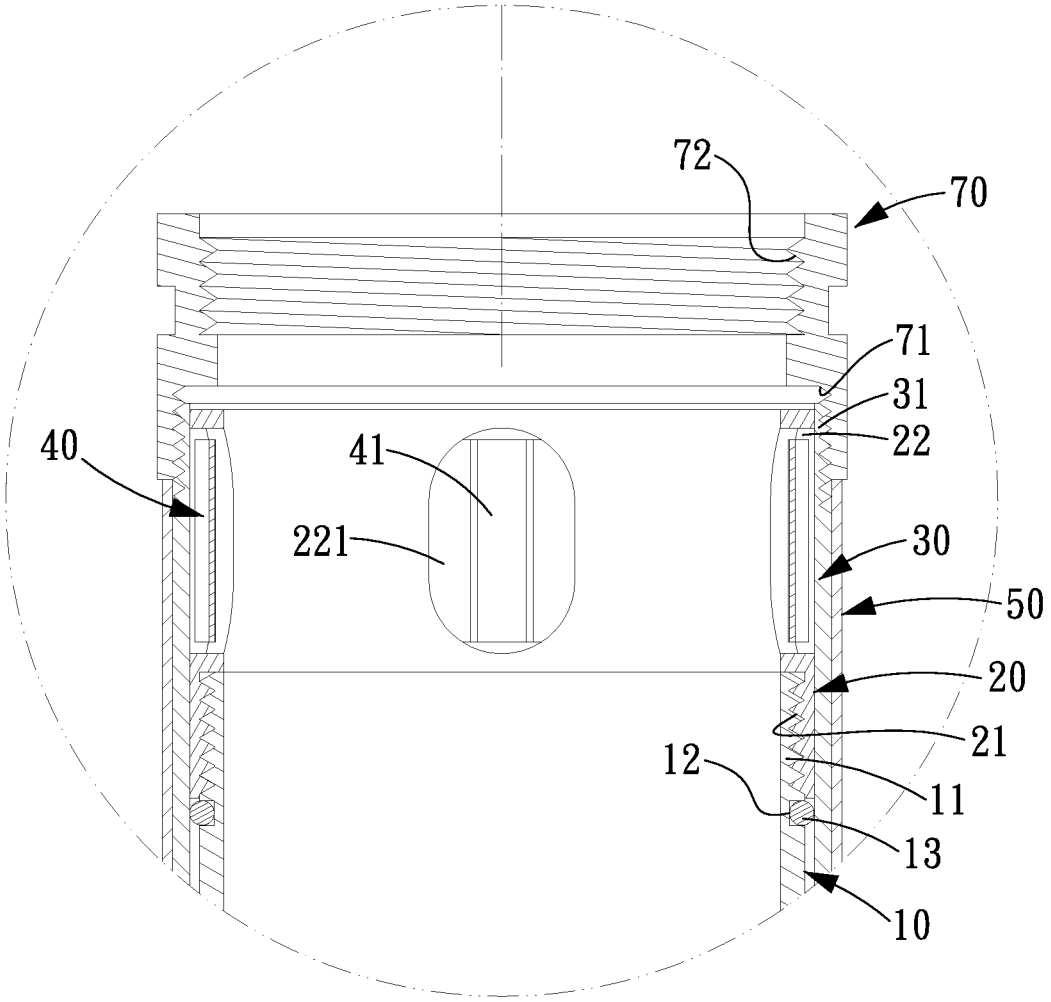
FIG. 4 is a partial enlarged view of FIG. 3.
Figure 5:
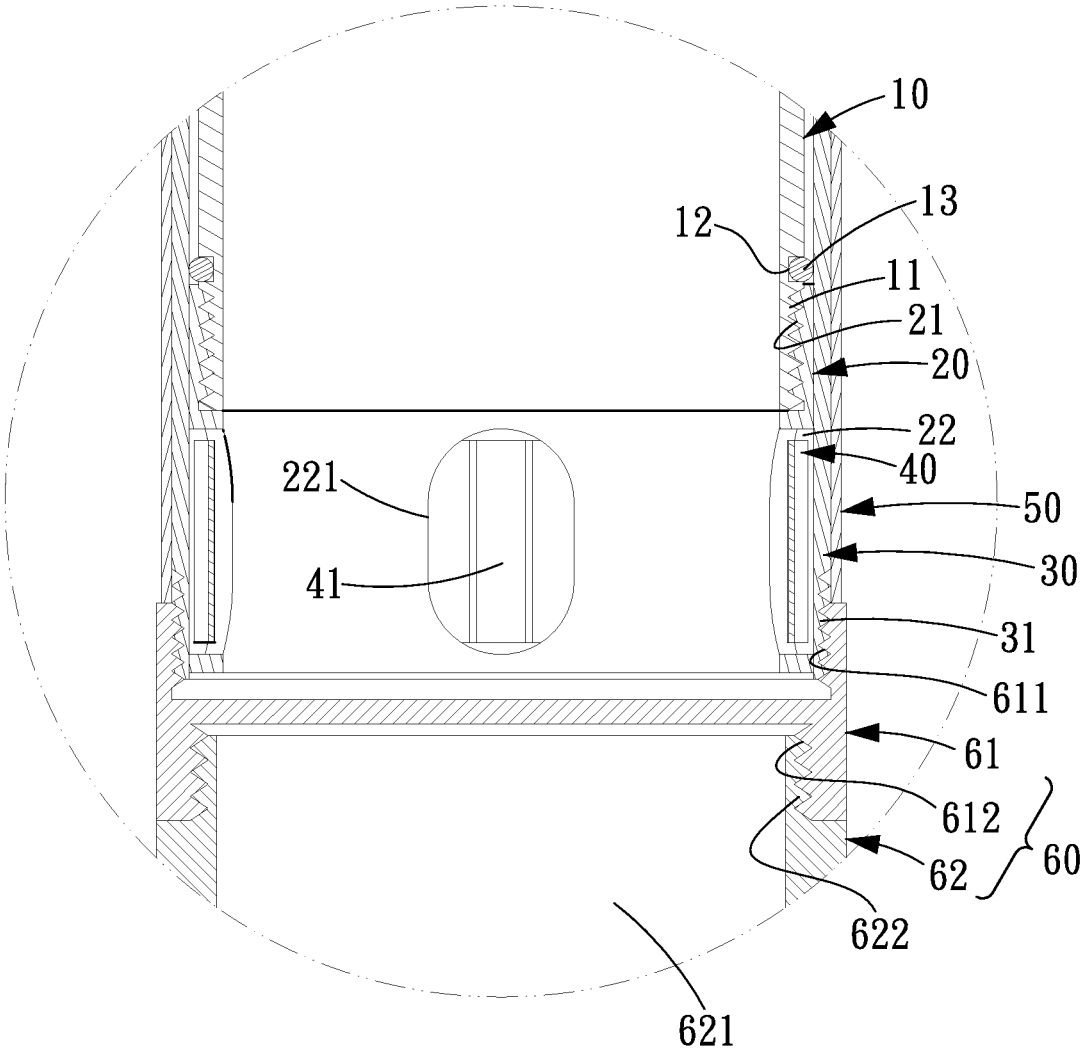
FIG. 5 is another partial enlarged view of FIG. 3.
Figure 6:
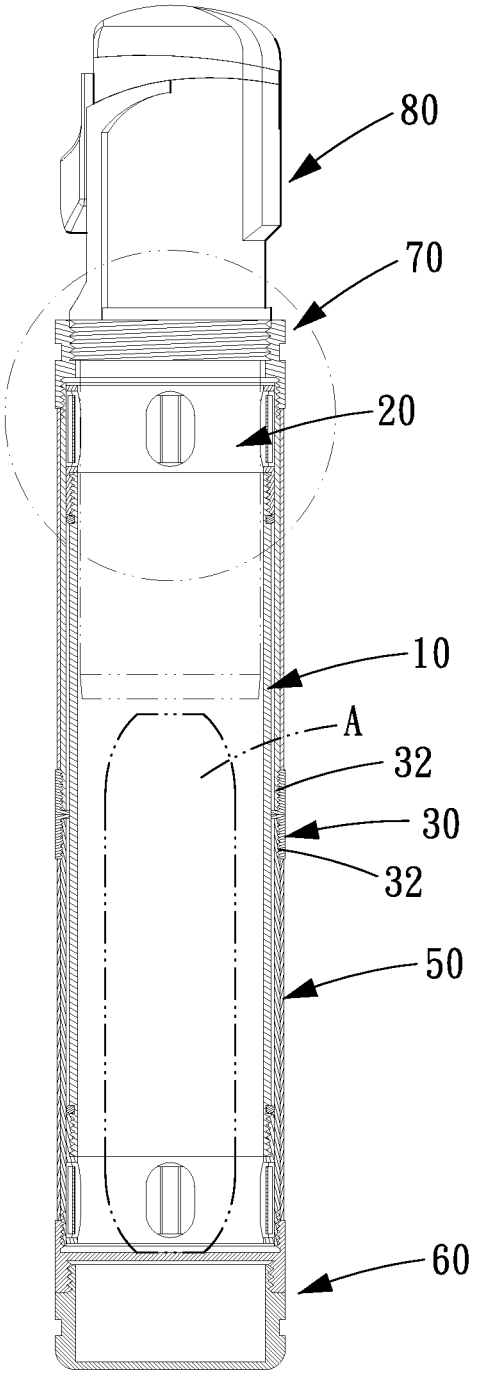
FIG. 6 is a cross-sectional view showing the lighter is combined on the bi-directional multiple-layer extension cigar holder in accordance with the present invention which is not adjusted in length.
Figure 7:
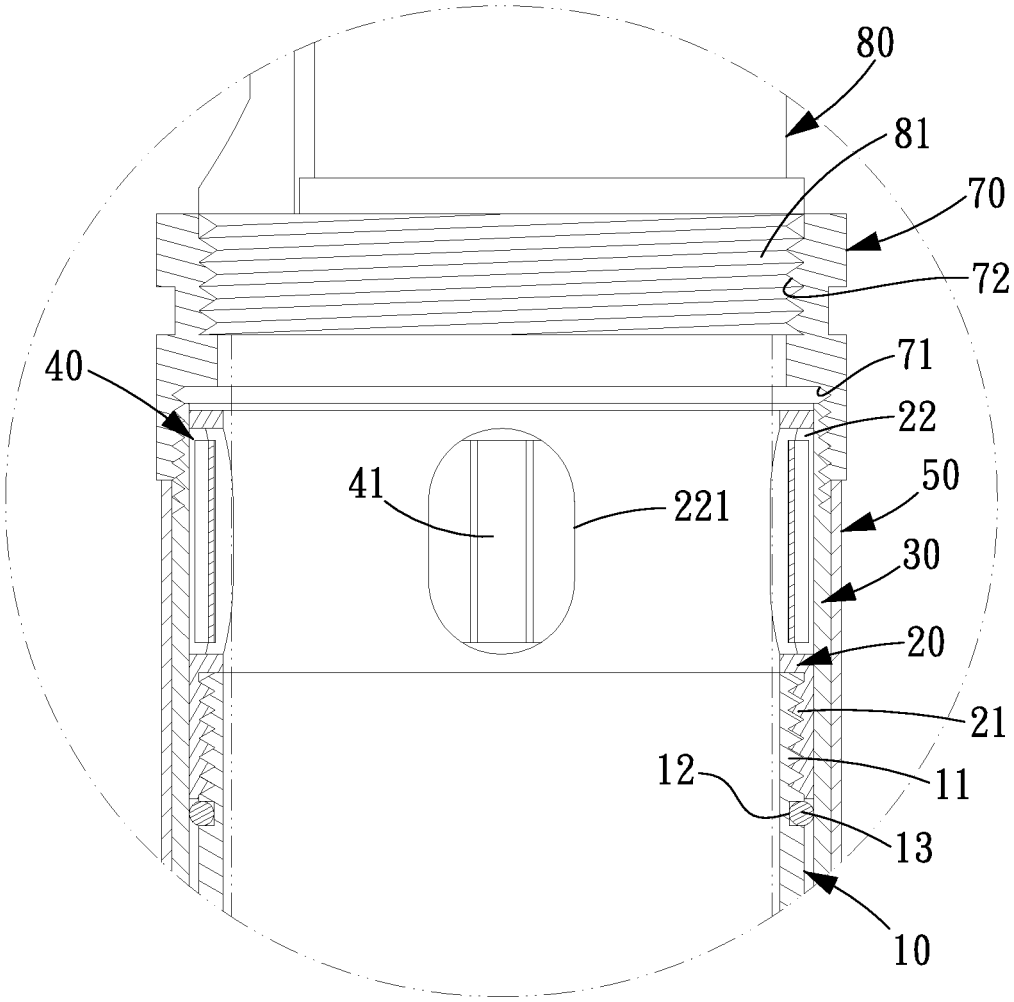
FIG. 7 is a cross-sectional view showing the lighter is combined on the bi-directional multiple-layer extension cigar holder in accordance with the present invention which is adjusted in length.

The present invention will be clearer from the following description when viewed together with the accompanying drawings, which show, for purpose of illustrations only, the preferred embodiment in accordance with the present invention.

Referring to FIGS. 1-10, a bi-directional multiple-layer extension cigar holder in accordance with a preferred embodiment of the present invention comprises receiving body 10, at least two circular bases 20, two extension tubes 30, at least two elastic retaining rings 40, two decorating sleeves 50, a bottom storage unit 60, a medium connecting element 70, and a lighter 80.

The receiving body 10 is in the form of a hollow tube and formed with an outer threaded portion 11 on each of two opposite ends thereof. An extending direction of the receiving body 10 is defined as an axial direction X. The receiving body 10 is formed in an outer surface thereof with two circular grooves 12 adjacent to the respective outer threaded portions 11. At least two O-shaped rings 13 are provided for cooperating with the circular grooves 12.

In the present embodiment, the present invention comprises two circular bases 20. Each of the circular bases 20 is formed in a first end thereof with an inner threaded portion 21, and a second end of each of the circular bases 20 is formed with a circular groove 22 in an outer surface thereof. Each of the circular grooves 22 is formed with plural through holes 221. The circular bases 20 are connected to the receiving body 10 by screwing the inner threaded portions 21 on the outer threaded portions 11.

Each of the two extension tubes 30 is formed with an outer threaded portion 31 on each of two opposite ends thereof and used together with an abutment end element 32. Each of the abutment end elements 32 includes an inner threaded portion 321 on an inner surface thereof. Each of the abutment end elements 32 is screwed with one of the outer threaded portions 31 of the respective extension tubes 30. The two extension tubes 30 are mounted on the receiving body 10 in such a manner that the two abutment end elements 32 are abutted against each other. The O-shaped rings 13 are engaged in the respective circular grooves 12 of the receiving body 10. The abutment end elements 32 of the two extension tubes 30 are located adjacent to each other.

In the present embodiment, the present invention comprises two elastic retaining rings 40 which are C-shaped elastic plates. Each of the elastic retaining rings 40 includes plural engaging protrusions 41 on an inner surface thereof. The elastic retaining rings 40 are received in the respective circular grooves 22 of the circular bases 20 in such a manner that the engaging protrusions 41 of the elastic retaining rings 40 are engaged in the through holes 221 of the circular grooves 22. The two circular bases 20 cooperates with the respective elastic retaining rings 40 and the O-shaped rings 13 of the receiving body 10 to prevent the disengagement of the two extension tubes 30.

The two decorating sleeves 50 are hollow thin tubes. Each of the two decorating sleeves 50 is provided with a decoration portion 51 on an outer surface thereof. An X directional length of each of the two decorating sleeves 50 equals an X directional distance from the abutment end element 32 of the respective extension tubes 30 to the outer threaded portion 31 of the corresponding extension tube 30. The decorating sleeves 50 are mounted on the respective extension tubes 30.

The bottom storage unit 60 includes a bottom cover 61 and a bottom storage element 62. The bottom cover 61 is formed with a first inner threaded portion 611 and a second inner threaded portion 612 in both ends thereof. One of the inner threaded portions 611, 612 is screwed to the other one of the outer threaded portions 31 of one of the extension tubes 30. In the present embodiment, the first inner threaded portion 611 of the bottom cover 61 is screwed on the outer threaded portion 31 of the one of the extension tubes 30. The bottom storage unit 60 has an open end and includes a storage space 621 in the open end thereof. The bottom storage unit 60 includes an outer threaded portion 622 on the open end thereof. The bottom storage element 62 is screwed to the second inner threaded portion 612 of the bottom cover 61 through the outer threaded portion 622 of the bottom storage unit 60.

The medium connecting element 70 is in the form of a ring and includes a first inner threaded portion 71 and a second inner threaded portion 72 in both ends thereof. The medium connecting element 70 is screwed on the other one of the outer threaded portions 31 of the other one of the two extension tube 30 through the first inner threaded portion 71, and the second inner threaded portion 72 is allowed to be screwed on the outer threaded portion 622 of the bottom storage element 62.

The lighter 80 includes an outer threaded portion 81 on an outer surface thereof. The lighter 80 is screwed into the second inner threaded portion 72 of the medium connecting element 70 through the outer threaded portion 81.

The aforementioned is the summary of the positional and structural relationship of the respective components of the preferred embodiment in accordance with the present invention.

Figure 8:
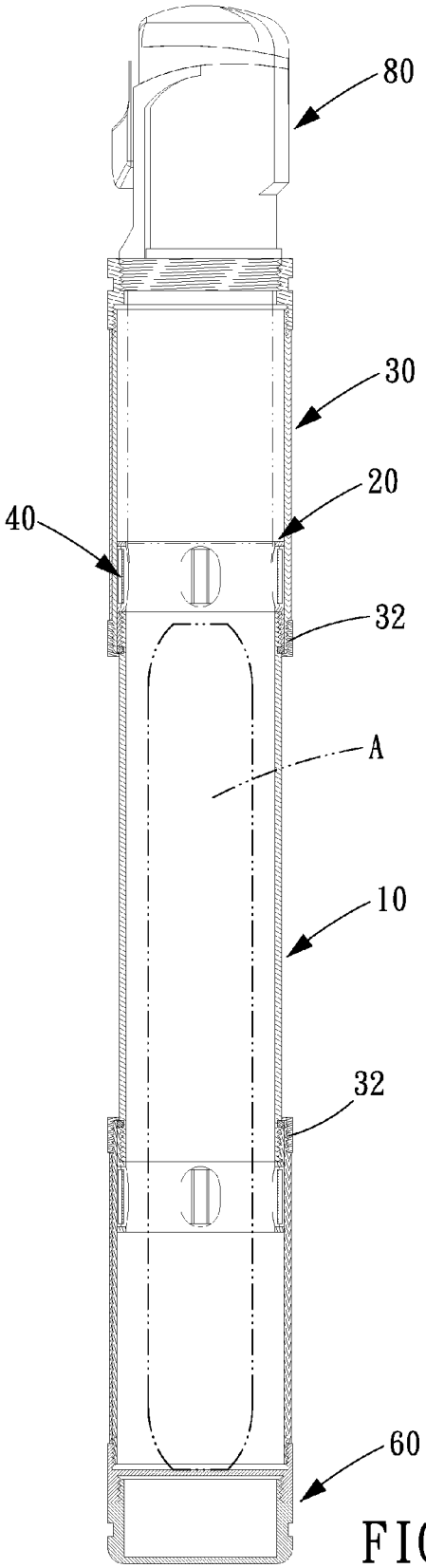
FIG. 8 is a partial enlarged view of FIG. 7.

After the assembly of the above respective components of the present invention is finished, cigars A may be held and stored in the receiving body 10, and the lighter 80 and the bottom storage unit 60 will seal both ends of the receiving body 10. When in use, the lighter 80 can be taken down when necessary, and when the lighter 80 is taken down, an end of the receiving body 10 is opened to allow the user to take out or put in the cigar A. When the length of the cigar A is greater than a length in the axial direction X of the receiving body 10, the user can pull the two extension tubes 30 by himself to make the two extension tubes move away from each other, so that the length of the receiving body 10 will be increased enough for holding the cigar A, as shown in FIG. 8. As known from this, the bi-directional multiple-layer extension cigar holder in accordance with the present invention can be adjusted in length by the user, improving its applicability. Since the bi-directional multiple-layer extension cigar holder in accordance with the present invention is assembled with the lighter 90, the user doesn't need to additionally carry a lighter, improving the use convenience.

Furthermore, in addition to facilitating positioning by cooperating with the through hole 221 of the respective circular bases 20, the respective elastic retaining rings 40 which are C-shaped elastic plates can further increase the convenience in assembly since it has a big-area configuration. Likewise, due to the big-area configuration, the elastic retaining rings 40 can offer a more stable function of preventing disengagement, ensuring the respective extension tubes 30 to have the best structure stability.

Figure 9:
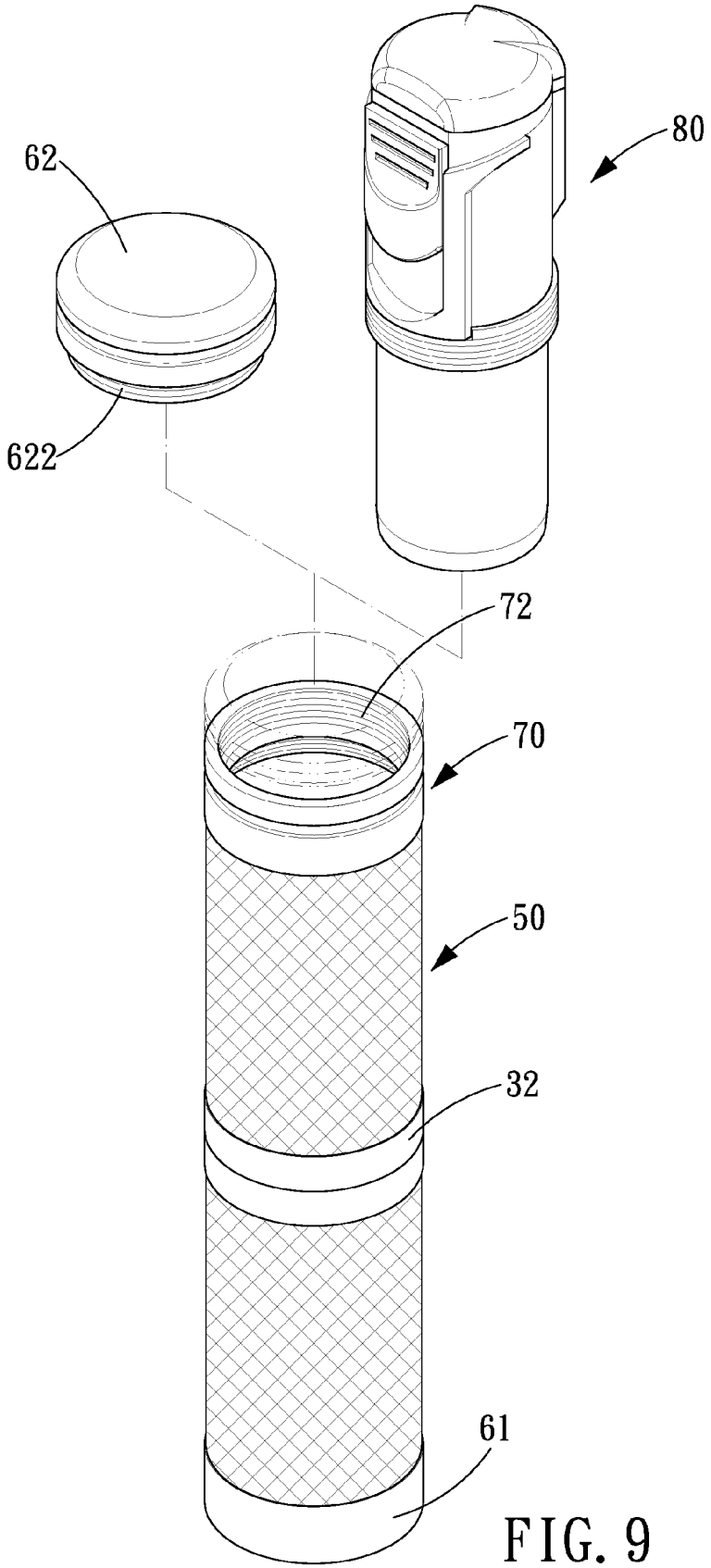
FIG. 9 is a perspective view showing that a bottom storage element is screwed to the medium connecting element of the bi-directional multiple-layer extension cigar holder in accordance with the present invention.
Figure 10:
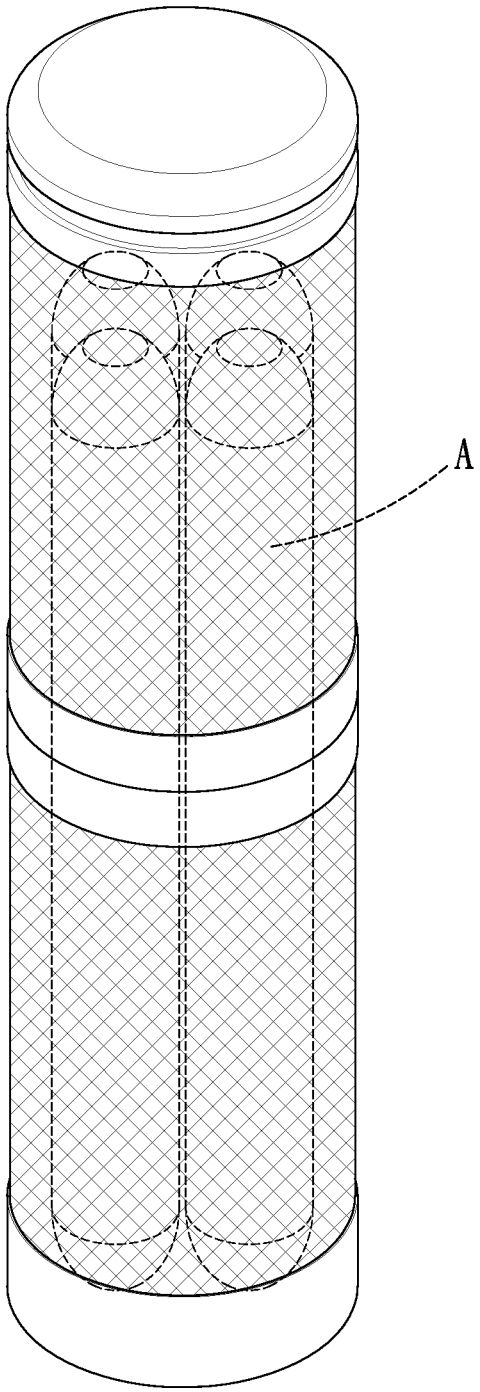
FIG. 10 is a perspective view showing the respective components of the bi-directional multiple-layer extension cigar holder in accordance with the present invention are increased in diameter for holding much more cigars.
Figure 11:
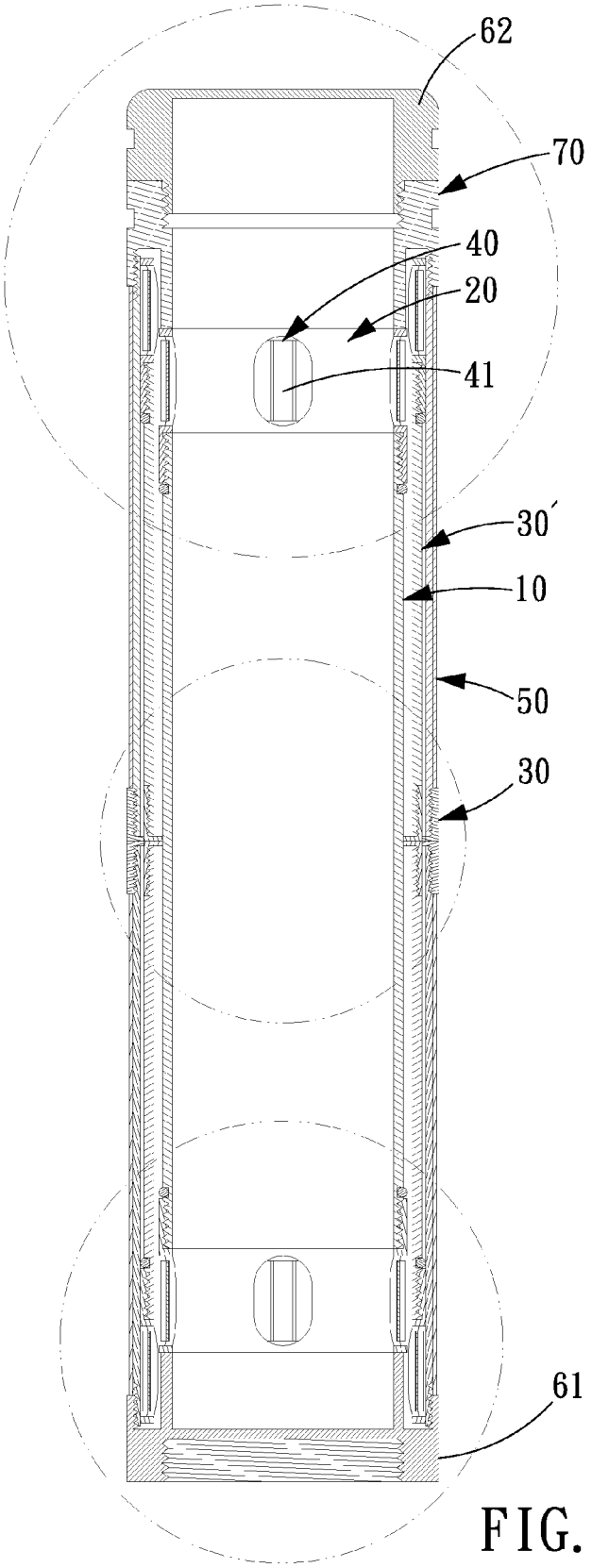
FIG. 11 is a partial cross-sectional showing a three-layer structure of bi-directional multiple-layer extension cigar holder in accordance with the present invention.
Figure 12:
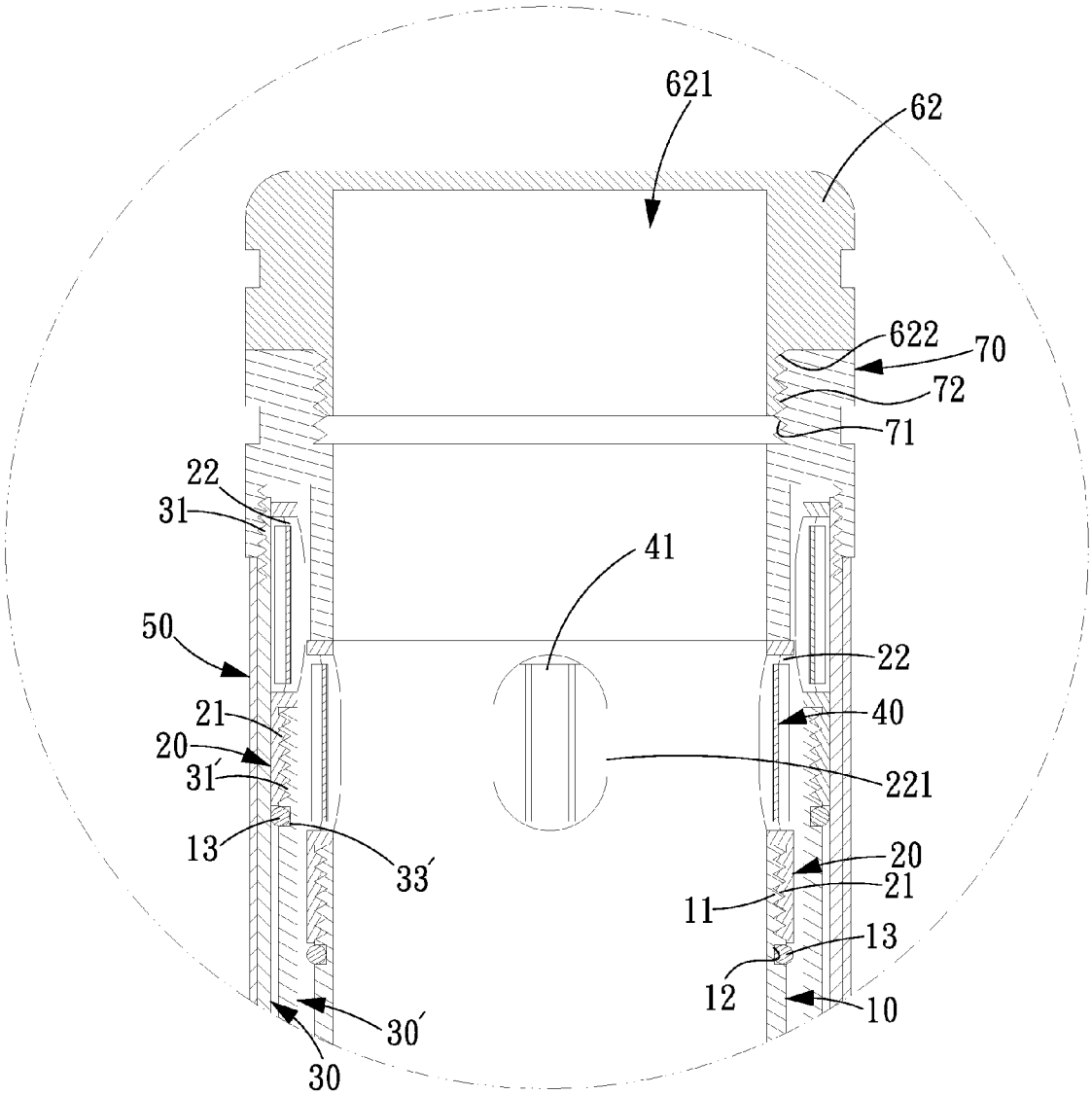
FIG. 12 is a partial enlarged view of FIG. 11.
Figure 13:
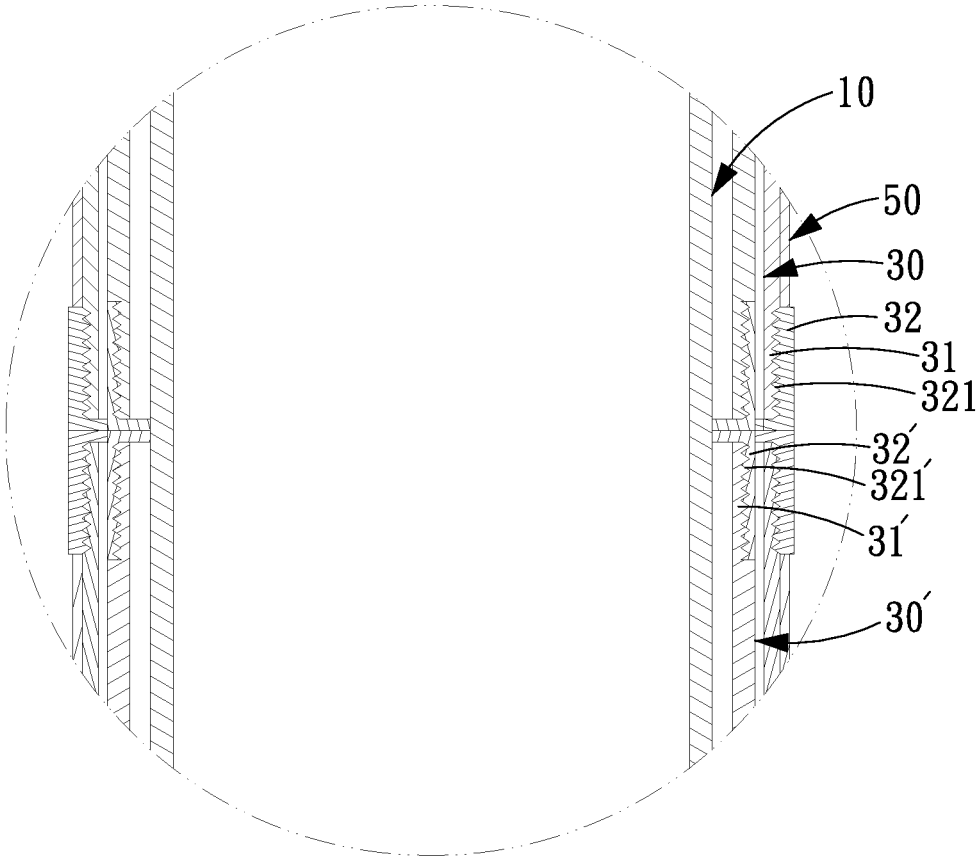
FIG. 13 is another partial enlarged view of FIG. 11.
Figure 14:
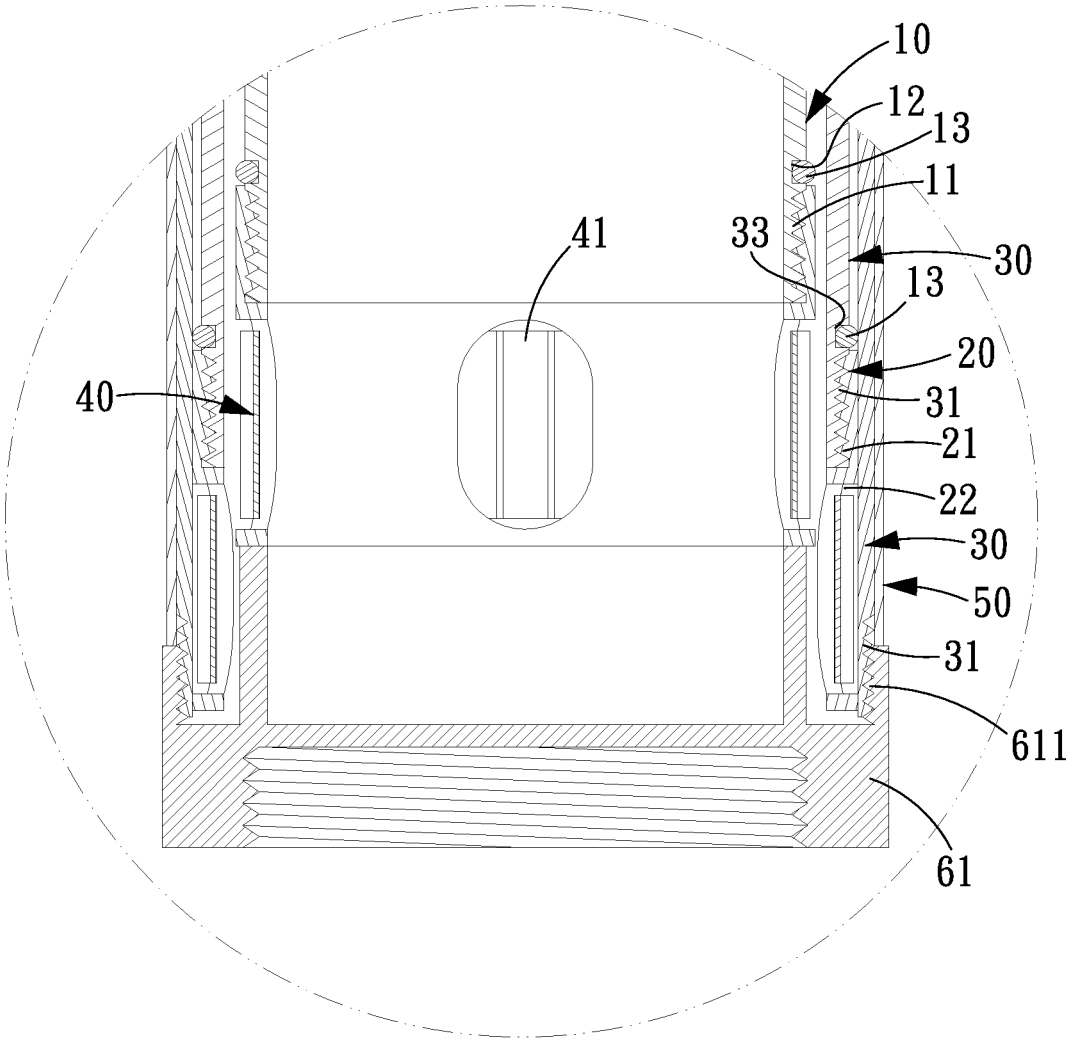
FIG. 14 is yet another partial enlarged view of FIG. 11.
Figure 15:
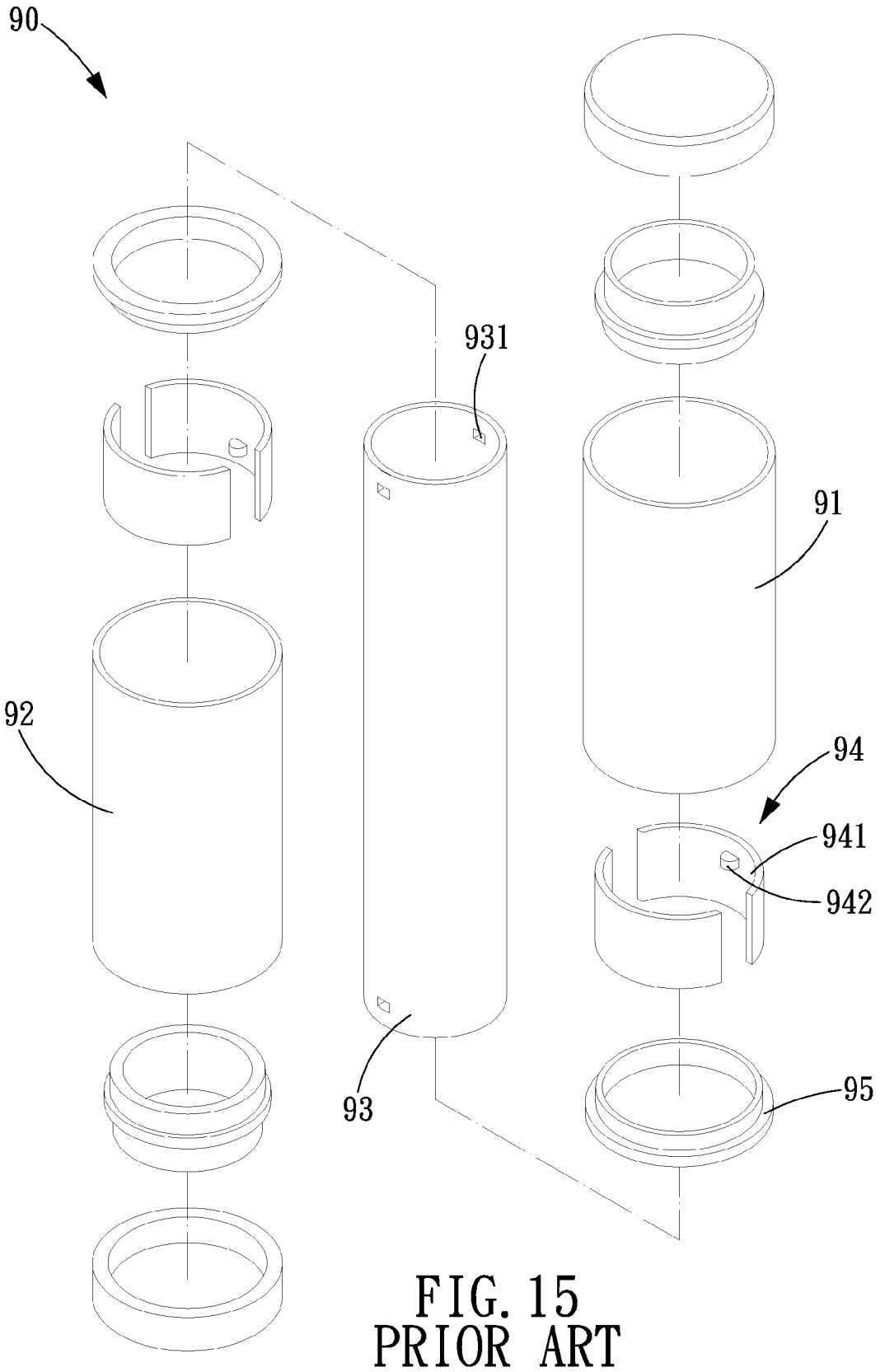
FIG. 15 PRIOR ART
FIG. 15 is an exploded view of a conventional cigar holder.

Further, as shown in FIG. 9, the lighter 80 can be taken down for use. After the lighter 90 is taken down, the bottom storage element 62 of the storage unit 60 can be disassembled from the bottom cover 61 and screwed to the second inner threaded portion 72 of the medium connecting element 70 through the outer threaded portion 622, so that the bottom cover 61 and the bottom storage element 62 of the bottom storage unit 60 can seal both ends of the cigar holder in accordance with the present invention to define a space therein for use. Further referring to FIG. 10, the respective components of the present invention can be increased in diameter such that the cigar holder in accordance with the present invention can hold much more cigars A, further increasing the applicability of the present invention.

Additionally, as shown in FIGS. 11-14, in another embodiment of the present invention, the cigar holder in accordance with the present invention can be further provided with two second extension tubes 30' on the receiving body 10, and then the two extension tubes 30 are mounted on the respective second extension tubes 30'. The second extension tubes 30' are in structure similar to the extension tubes 30. Each of the second extension tubes 30' includes an outer threaded portion 31' on each of two opposite ends thereof. The outer threaded portion 31' on a first end of each of the second extension tube 30' is screwed to a second abutment end element 32' having an inner threaded portion 321' on an inner surface thereof, and the outer threaded portions 31' on a second end of each of the second extension tubes 30' is screwed to the inner threaded portion 21 of the respective circular bases 20. The elastic retaining rings 40 are also engaged on the respective circular bases 20. In addition, the respective second extension tubes 30' are formed in an outer surface thereof with a circular groove 33' which is located adjacent to the outer threaded portion 31 on the second end of the corresponding second extension tube 30'. An O-shaped ring 13 is disposed in the circular groove 33'. The respective second extension tubes 30' are mounted on the receiving body 10 in such a manner that the second abutment end elements 32' are abutted against each other, and the respective extension tubes 30 are then mounted on the respective second extension tubes, such that a three-layer extension structure in accordance with the present invention is obtained, widening the length adjustment range while further enhancing the operation applicability.

While we have shown and described various embodiments in accordance with the present invention, it is clear to those skilled in the art that further embodiments may be made without departing from the scope of the present invention.

What is claimed is:

1. A bi-directional multiple-layer extension cigar holder comprising:

a receiving body being in the form of a hollow tube;

at least two circular bases being connected to both ends of the receiving body and formed with circular grooves having plural through holes in an outer surface thereof;

two extension tubes each being formed with an outer threaded portion on each of two opposite ends thereof and mounted on the receiving body, respectively;

at least two elastic retaining rings being C-shaped elastic plates, each of the elastic retaining rings including plural engaging protrusions on an inner surface thereof, the engaging protrusions of the elastic retaining rings being engaged in the through holes of the circular grooves;

a bottom storage unit being screwed to one of the outer threaded portions of one of the two extension tubes;

a medium connecting element being in the form of a ring and including a first inner threaded portion at a first end and a second inner threaded portion at a second end, the medium connecting element being screwed on one of the outer threaded portions of the other one of the two extension tubes through the first inner threaded portion; and a lighter including an outer threaded portion on an outer surface thereof, the lighter being screwed into the second inner threaded portion of the medium connecting element through the outer threaded portion thereof.

2. The bi-directional multiple-layer extension cigar holder as claimed in claim 1, wherein the number of the circular bases is two, the number of the elastic retaining rings is two.

3. The bi-directional multiple-layer extension cigar holder as claimed in claim 1, wherein the receiving body is formed with an outer threaded portion on each of two opposite ends thereof, each of the circular bases is formed in a first end thereof with an inner threaded portion, the circular bases are connected to the receiving body by screwing the inner threaded portions of the circular bases on the outer threaded portions of the receiving body.

4. The bi-directional multiple-layer extension cigar holder as claimed in claim 1, wherein each of the circular bases is formed in a first end thereof with an inner threaded portion, and a second end of each of the circular bases is formed with a circular groove in the respective outer surface of the circular bases, the through holes of the respective circular bases penetrate the respective circular groove of the circular bases.

5. The bi-directional multiple-layer extension cigar holder as claimed in claim 1 further comprising at least two abutment end elements, each of the two abutment end elements including an inner threaded portion on an inner surface thereof, the abutment elements being screwed to the other one of the outer threaded portions of the respective extension tubes, the two extension tubes being engaged on the receiving body in such a manner that the two abutment end elements are located adjacent to each other.

6. The bi-directional multiple-layer extension cigar holder as claimed in claim 1, wherein the receiving body is formed with an outer threaded portion on each of two opposite ends thereof, and the receiving body is formed in an outer surface thereof with two circular grooves adjacent to the respective outer threaded portions, after the respective extension tubes are mounted on the receiving body, two O-shaped rings will be disposed in the two circular grooves of the receiving body, respectively.

7. The bi-directional multiple-layer extension cigar holder as claimed in claim 1, wherein a second end of each of the circular bases is formed with a circular groove in the respective outer surface of the circular bases, the respective elastic retaining rings are disposed in the circular grooves of the respective circular bases.

8. The bi-directional multiple-layer extension cigar holder as claimed in claim 1 further comprising two decorating sleeves which are hollow thin tubes, each of the two decorating sleeves being provided with a decoration portion on an outer surface thereof, the decorating sleeves being mounted on the respective extension tubes.

9. The bi-directional multiple-layer extension cigar holder as claimed in claim 1, wherein the bottom storage unit includes a bottom cover and a bottom storage element, the bottom cover is formed with a first inner threaded portion and a second inner threaded portion in both ends thereof, one of the inner threaded portions of the bottom cover is screwed to the one of the outer threaded portions of the one of the two extension tubes, the bottom storage element has an open end and includes a storage space in the open end thereof, the bottom storage element includes an outer threaded portion on the open end thereof, the bottom storage element is screwed to the second inner threaded portion of the bottom cover through the outer threaded portion of the bottom storage element.

10. The bi-directional multiple-layer extension cigar holder as claimed in claim 1 further comprising two second extension tubes, two circular bases, two elastic retaining rings, two O-shaped rings, the two second extension tubes being mounted on the receiving body and each including an outer threaded portion on each of two opposite ends thereof, the outer threaded portion on a first end of each of the second extension tube being screwed to a second abutment end element having an inner threaded portion on an inner surface thereof, and the outer threaded portion on a second end of each of the second extension tubes being screwed to an inner threaded portion of the respective circular bases, the elastic retaining rings being engaged on the respective circular bases, the respective second extension tubes being formed in an outer surface thereof with a circular groove which is located adjacent to the outer threaded portion on the second end of the corresponding second extension tube, the O-shaped rings being disposed in the circular grooves of the second extension tubes, the respective second extension tubes being mounted on the receiving body in such a manner that the second abutment end elements are abutted against each other, and the respective extension tubes are then mounted on the respective second extension tubes.

* * * * *